US007122997B1

(12) United States Patent
Werking

(10) Patent No.: US 7,122,997 B1
(45) Date of Patent: Oct. 17, 2006

(54) TEMPERATURE COMPENSATED LOW VOLTAGE REFERENCE CIRCUIT

(75) Inventor: Paul M. Werking, Rockford, MN (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 11/267,361

(22) Filed: Nov. 4, 2005

(51) Int. Cl.
*G05F 3/18* (2006.01)

(52) U.S. Cl. ..... 323/313; 323/316; 323/907

(58) Field of Classification Search ..... 323/312, 323/313, 314, 315, 316, 907; 327/538, 539, 327/540, 542
See application file for complete search history.

(56) References Cited

U.S. PATENT DOCUMENTS

| | | | | |
|---|---|---|---|---|
| 3,617,859 | A | 11/1971 | Dobkin et al. | |
| 3,754,181 | A | 8/1973 | Kreitz et al. | |
| 3,887,863 | A | 6/1975 | Brokaw | |
| 4,447,784 | A | 5/1984 | Dobkin | |
| 4,525,663 | A | 6/1985 | Henry | |
| 4,902,959 | A | 2/1990 | Brokaw | |
| 5,942,887 | A | 8/1999 | Annema | |
| 6,249,176 | B1 * | 6/2001 | Pease | 327/538 |
| 6,426,669 | B1 | 7/2002 | Friedman et al. | |
| 6,501,256 | B1 * | 12/2002 | Jaussi et al. | 323/315 |
| 6,529,066 | B1 | 3/2003 | Guenot et al. | |
| 6,630,859 | B1 * | 10/2003 | Wang | 327/539 |
| 6,677,808 | B1 * | 1/2004 | Sean et al. | 327/539 |
| 6,693,415 | B1 * | 2/2004 | Johnson | 323/313 |
| 6,710,583 | B1 * | 3/2004 | Stanescu et al. | 323/280 |
| 6,750,641 | B1 * | 6/2004 | Ivanov et al. | 323/315 |

OTHER PUBLICATIONS

R. J. Widlar, "New Development in IC Voltage Regulators," *IEEE Journal of Solid-State Circuits*, vol. SC-6, pp. 2-7, Feb. 1971.
K. E. Kuijk, "A Precision Reference Voltage Source," *IEEE Journal of Solid-State Circuits*, vol. SC-8, pp. 222-226, Jun. 1973.
A. P. Brokaw, "A Simple Three-Terminal IC Bandgap Reference," *IEEE Journal of Solid-State Circuits*, vol. SC-9, pp. 388-393, Dec. 1974.
Gerard C. M. Meijer and Jan B. Verhoeff, "An Integrated Bandgap Reference," *IEEE Journal of Solid-State Circuits*, vol. SC-11, pp. 403-406, Jun. 1976.
Eric A. Vittoz, "MOS Transistors Operated in the Lateral Bipolar Mode and Their Application in CMOS Technology," *IEEE Journal of Solid-State Circuits*, vol. SC-18, No. 3, pp. 273-279, Jun. 1983.
Marc G. R. Degrauwe, Oskar N. Leuthold, Eric A. Vittoz, Henri J. Oguey, and Arthur Descombes, "CMOS Voltage References Using Lateral Bipolar Transistors," *IEEE Journal of Solid-States Circuits*, vol. SC-20, No. 6, pp. 1151-1157, Dec. 1985.

(Continued)

*Primary Examiner*—Adolf Berhane
(74) *Attorney, Agent, or Firm*—McDonnell Boehnen Hulbert & Berghoff LLP

(57) ABSTRACT

A temperature compensated low voltage reference circuit can be realized with a reduced operating voltage overhead. This is accomplished in several ways including minimizing drain voltage variation at the drains of two inter-connected transistors and implementing a current conveyer in order to adjust the temperature coefficient of an output current or voltage. Various combinations of voltage minimization and temperature coefficient adjustments may be used to design a reference circuit to a circuit designer's preference. A temperature compensated current source may also be created. The temperature compensated current source may be used to provide a wide range of output voltages. All of the reference circuits may be constructed with various types of transistors including DTMOS transistors.

23 Claims, 11 Drawing Sheets

OTHER PUBLICATIONS

Hironori Banba, Hitoshi Shiga, Akira Umezawa, Takeshi Miyaba, Toru Tanzawa, Shigeru Atsumi, and Kojl Sakui, "A CMOS Bandgap Reference Circuit with Sub-1-V Operation," *IEEE Journal of Solid-State Circuits*, vol. SC-34, pp. 670-674, May 1999.

Anne-Johan Annema, "Low-Power Bandgap References Featuring DTMOST's," *IEEE Journal of Solid-State Circuits*, vol. 34, No. 7, pp. 949-955, Jul. 1999.

Ka Nang Leung and Philip K. T. Mok, "A Sub-1-V 15-ppm/° C. CMOS Bandgap Voltage Reference Without Requiring Low Threshold Voltage Device," *IEEE Journal of Solid-State Circuits*, vol. 37, No. 4, pp. 526-530, Apr. 2002.

Jiwei Chen and Bingxue Shi, "1V CMOS Current Reference with 50ppm/° C. Temperature Coefficient," *Electronics Letters*, vol. 39, No. 2, pp. 209-210, Jan. 23, 2003.

* cited by examiner

TEMPERATURE COMPENSATED LOW VOLTAGE REFERENCE CIRCUIT

BACKGROUND

1. Field of Invention

The present invention relates to semiconductor integrated circuits, and more specifically, to a low voltage reference circuit that is capable of outputting a plurality of voltages with minimal operating voltage overhead.

2. Description of Related Art

Voltage reference circuits are a critical component of many analog, digital and mixed-signal integrated circuits. Circuits such as oscillators, Phase Locked Loops (PLLs), and Dynamic Random Access Memories (DRAM) depend on stable, temperature independent voltage references. Most voltage references in use today require an operating voltage of at least 1.3 V. This is especially true for three terminal series regulated voltage references (a more desirable voltage reference due to reduced power dissipation). The output ranges of these devices vary from 1.3 V (for a bipolar process) to 1.6 V or more (for a CMOS process). As operating voltages of integrated circuits decrease with decreasing critical dimensions, the need has arisen for lower operating voltages of voltage reference circuits. At the same time, however, these reference circuits need to maintain their temperature independence. Therefore, it is desirable to provide a temperature compensated voltage reference circuit that minimizes overhead, functions at operating voltages at or below 1.3V and provides a stable reference voltage output.

SUMMARY

The present invention provides a circuit for creating a temperature compensated voltage output with a reduced operational input voltage overhead. In one embodiment a voltage reference circuit employs voltage regulating circuitry to reduce voltage differences caused by short channel effects. The reduction of these differences allows for a lower overhead voltage. In a second embodiment these voltage differences are reduced by regulating circuit nodes within the voltage reference circuit with Bipolar Junction Transistors (BJTs) which have more ideal characteristics. In the above embodiments the voltage reference circuit may be a bandgap reference circuit or a sub-bandgap reference circuit.

In a third embodiment a sub-bandgap low voltage reference circuit uses a current conveyer as a temperature coefficient adjustment circuit to balance the temperature coefficients of an output current. The resultant output current is temperature compensated. In a fourth embodiment the current conveyer may be replaced with a single resistor to balance the temperature coefficient of the output current. An additional resistor may be used in these embodiments to create a temperature compensated voltage from the output current.

Various other embodiments are described where the above embodiments are used in combination with each other to offer an assortment of temperature compensated circuits that a circuit designer could use for a voltage reference with minimized voltage overhead.

In addition to the above embodiments, a temperature compensated current source is also presented that uses the ground terminal of a current differencing amplifier to balance the temperature coefficients of an output current. The temperature compensated current source may also be used with a resistor to create a temperature compensated voltage output. Other embodiments may also comprise different types of transistors such as DTMOS transistors.

These as well as other aspects and advantages of the present invention will become apparent to those of ordinary skill in the art by reading the following detailed description, with appropriate reference to the accompanying drawings.

BRIEF DESCRIPTION OF THE DRAWINGS

Preferred embodiments of the present invention are described with reference to the following drawings, wherein.

DETAILED DESCRIPTION

In view of the wide variety of embodiments to which the principles of the present invention can be applied, it should be understood that the illustrated embodiments are examples only, and should not be taken as limiting the scope of the present invention.

Several embodiments of a temperature compensated voltage reference circuit are presented. All of the embodiments seek to lower the input voltage required for a voltage reference circuit. One circuit for minimizing overhead voltages includes circuitry that regulates the voltage at the drains of two FETs within a voltage reference circuit. This regulating circuitry may be placed in a bandgap or sub-bandgap reference circuit. In other embodiments a temperature coefficient adjustment circuit is used in a sub-bandgap circuit. The temperature coefficient adjustment circuit may be a current conveyer or a resistor that is tapped off one node of the reference circuit. The extra current (or voltage) assists in balancing the temperature coefficient of an output current. The output current may also be used to provide a voltage. Both the voltage and the current are temperature compensated.

Various other combinations of the above circuits are presented. One example is a sub-bandgap reference circuit that also employs voltage regulating circuitry. Another current source using the ground terminal of a current differencing amplifier as an extra current to balance the temperature coefficient of an output current is also present. This circuit may also be used to create a temperature compensated voltage output.

Figure 1:
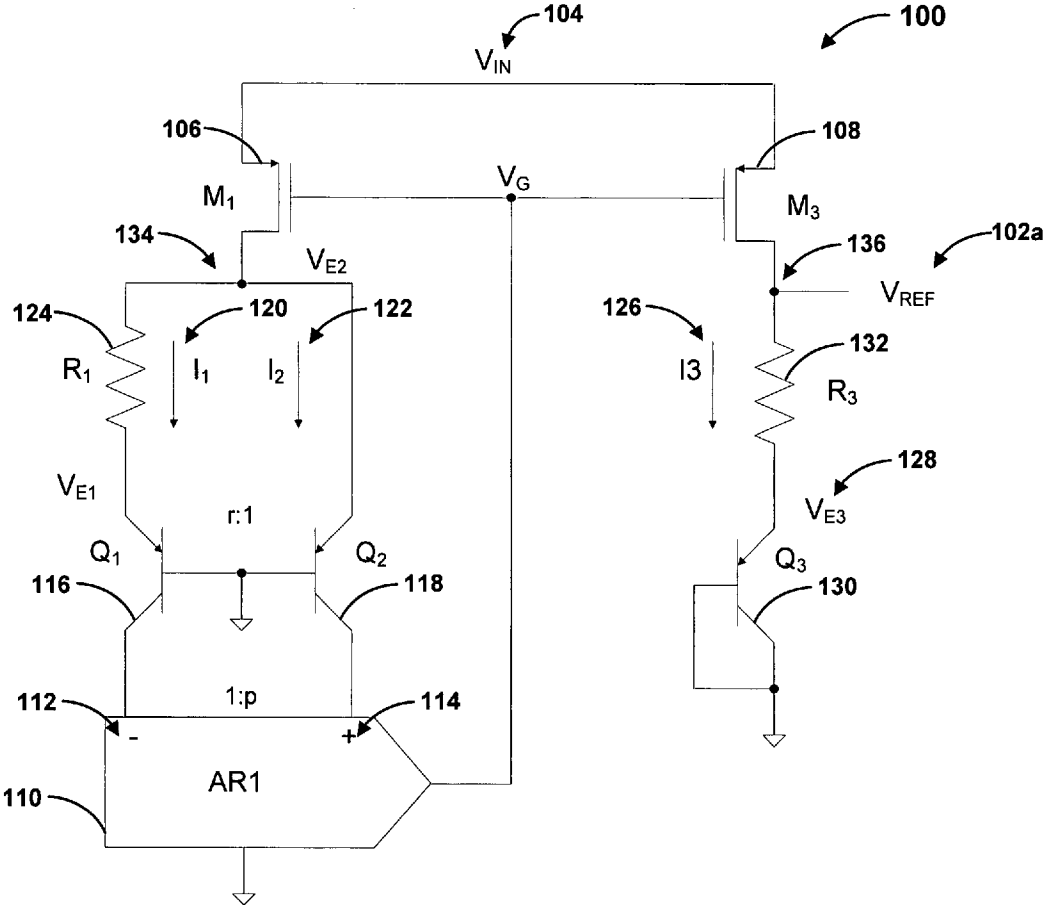
FIG. 1 (Prior Art)
FIG. 1 is a schematic drawing of a conventional voltage reference circuit.

Turning now to the figures, FIG. 1 is a schematic drawing of a temperature compensated voltage reference circuit. The reference voltage is taken from $V_{REF}$ 102 and is referenced to ground. Depending on the substrate that the reference circuit is manufactured on (i.e., Silicon, GaAs, etc.) the voltage at $V_{REF}$ 102 will nominally be the bandgap voltage of the substrate. For example, if the substrate is silicon the output voltage will be approximately 1.12 V. The operating voltage is designated as $V_{IN}$ 104 and it is applied at the node of the connected sources of transistors $M_1$ 106, and $M_3$ 108. $V_{IN}$ 104 has a minimum allowable value equal to $V_{REF}$ plus an overhead voltage. The circuit 100 employs a feedback network comprised of a current-differencing amplifier AR1 110. AR1 110 translates a difference in currents into an output voltage. This amplifier can be made in various ways as long as the operating voltage, $V_{IN}$ 104, is not limited by its design. Terminals $V_{C1}$ 112 and $V_{C2}$ 114 should be relatively close to 0 V as any output voltage above approximately 0.3 V at these terminals allows PNP transistors $Q_1$ 116 and $Q_2$ 118 to operate in saturation (at high temperatures) and it prevents conduction of parasitic substrate PNP transistors from $Q_1$ 116 and $Q_2$ 118.

The collector current of transistors $Q_1$ 116 ($I_1$ 120) and $Q_2$ 118 ($I_2$ 122) have a designed ratio:

$$p=I_2/I_1$$

This ratio is typically 1:1 but it can vary depending on the design of the circuit. The area of both transistors is also designed to have a ratio given by:

$$r=A_1/A_2$$

Assuming that the collector currents of $Q_1$ 116 and $Q_2$ 118 are equal to their respective emitter currents, the currents $I_1$ 120 and $I_2$, 122 through transistors $Q_1$ 116 (and $R_1$ 124) and $Q_2$ 118 are determined by:

$$I_1=(V_T/R_1)\ln(p\cdot r)$$

$$I_2=pI_1$$

Where:

$$V_T=kT/q$$

If the design of $M_1$ 106 is matched to the design of $M_3$ 108, which is not necessarily required, the current through transistor $M_3$ 108 ($I_3$ 126) is the sum of $I_1$ 120 and $I_2$ 122 and can be calculated as:

$$I_3=(p+1)(V_T/R_1)\ln(p\cdot r)$$

All of the currents, $I_1$ 120, $I_2$ 122, and $I_3$ 126, are dependent on $V_T$, which is Proportional-To-Absolute-Temperature (PTAT); as temperature increases, $V_T$ increases and thus these three currents increase. The voltage $V_{E3}$ 128, at the emitter of $Q_3$ 130 is Complementary-To-Absolute-Temperature (CTAT). Multiplying the current $I_3$ by the resister $R_3$ 132 and adding the voltage $V_{E3}$, creates the output voltage $V_{REF}$ 102 and is calculated as:

$$V_{REF}=V_{E3}+(p+1)(R_3/R_1)V_T\ln(p\cdot r)$$

Figure 2:
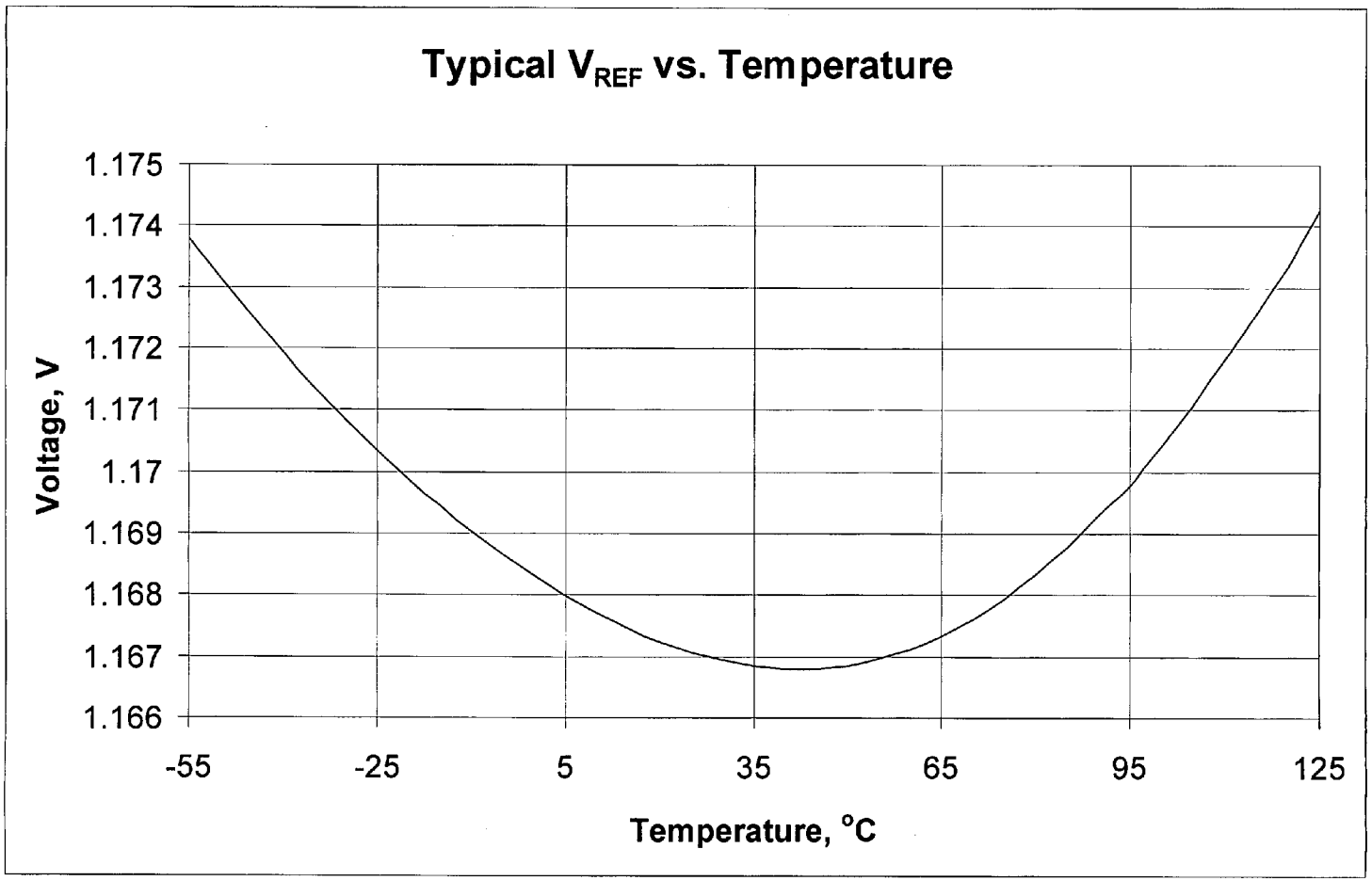
FIG. 2 (Prior Art)
FIG. 2 is a graph illustrating $V_{REF}$ vs. temperature of the circuit in FIG. 1.

$V_{REF}$ 102 can be made temperature independent by considering the temperature coefficients of both terms of the equation. The first term of the equation, $V_{E3}$ 128, has a negative temperature coefficient of −2 mV/° C. and the second term has a positive temperature coefficient. This positive temperature coefficient can be designed by choosing $R_3/R_1$, p and r. By setting the positive temperature coefficient to +2 mV/° C., the two terms cancel each other and a stable temperature compensated voltage reference results. A graph of typical $V_{REF}$ vs. Temperature is displayed in FIG. 2.

The problem, as stated previously, is that the operating voltage necessary to create the desired output $V_{REF}$ 102, namely $V_{IN}$ 104, needs to be lowered as device sizes are reduced. As discussed above, conventional voltage reference circuits with MOS transistors operate around 1.6 V, (300–400 mV above $V_{REF}$ 102); this is due to power supply rejection (PSR) limitations which are caused by varying drain voltages in M1 106 (node 134) and M3 130 (node 136). These varying drain voltages are induced by channel length modulation. The 300–400 mV overhead is due to increasing the lengths of M1 106 and M3 108 or using compound transistors to compensate for channel length modulation. Even if the MOS transistors M1 106 and M3 108 are replaced with bipolar transistors, the required overhead is still in the range of 100 mV. Clearly, in order to reduce unwanted overhead, the varying drain voltages of $M_1$ 106 and $M_3$ 108 need to be minimized. The following embodiments provide a reliable, temperature compensated, voltage reference by minimizing drain voltage variation.

Figure 3B:
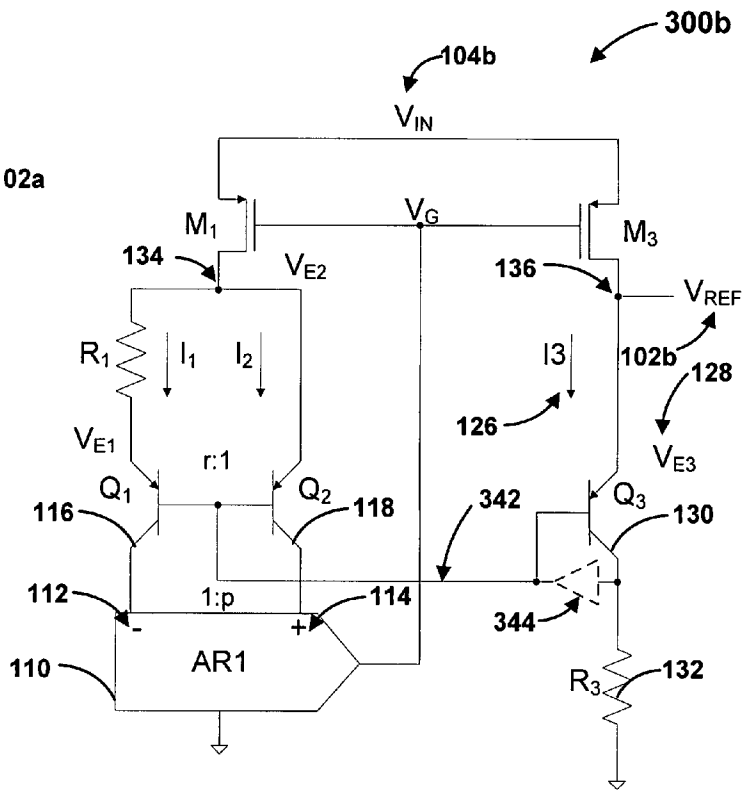
FIG. 3*b* is a schematic drawing of a temperature compensated voltage reference circuit implementing an additional BJT as a voltage regulator in accordance with one embodiment of the present invention.
Figure 3A:
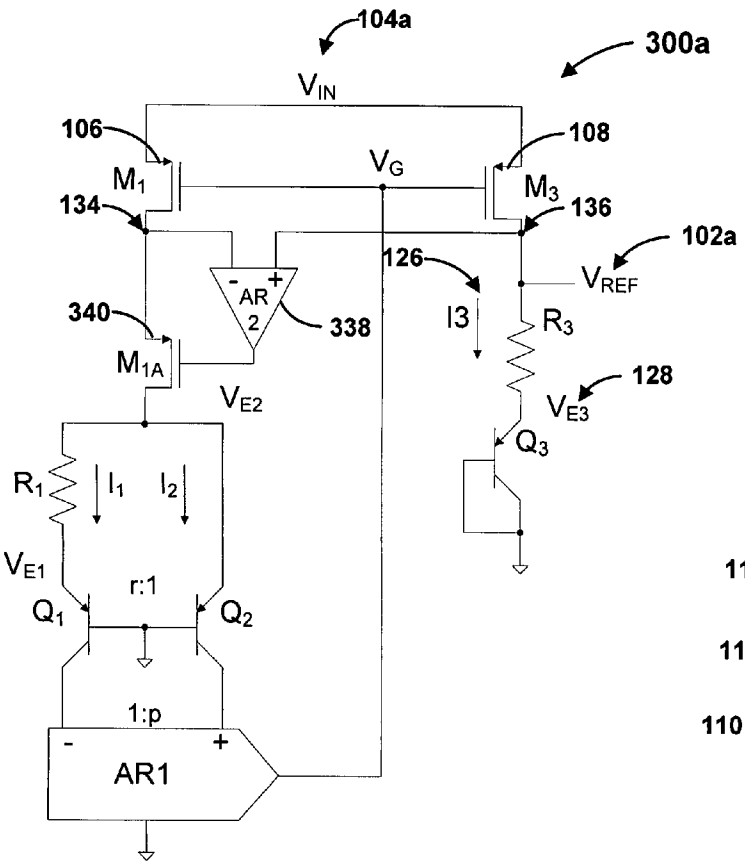
FIG. 3*a* is a schematic drawing of a temperature compensated voltage reference circuit implementing an amplifier and a FET as a voltage regulator in accordance with one embodiment of the present invention.

In the embodiment of FIG. 3*a*, one embodiment of a temperature compensated voltage reference circuit 300*a* is illustrated. The goal of this circuit is to minimize unnecessary overhead by minimizing the voltage difference at the drains of transistors $M_1$ 106 and $M_3$ 108 (nodes 134 and 136 respectively). This circuit outputs a stable reference voltage $V_{REF}$ 102*a* at the same node as in the circuit 100 of FIG. 1.

Reference circuit 300*a* employs an operational amplifier 338 and a PMOS transistor 340 to reduce operational voltage overhead. Many different types of amplifiers may be used for amplifier 338. Two inputs of the amplifier 338 (AR2) connect nodes 134 and 136. The gate of the PMOS transistor $M_{1A}$ 340 is coupled with the output of AR2 338. AR2 338 in combination with $M_{1A}$ 340 serves to regulate the voltage at nodes 134 and 136. Because both of these nodes are now regulated at a similar voltage, the impact of the PSR limitations due to drain voltage variation is eliminated, allowing a stable operating voltage, $V_{IN}$, 104*a* with reduced overhead (about 100 mV above $V_{REF}$ 102*a*). Like the circuit of FIG. 1, this circuit achieves temperature stability by equating the temperature coefficients of the first and second terms (namely $V_{E3}$ 128 and $I_3$ 126) in the following equation:

$$V_{REF}=V_{E3}+(p+1)(R_3/R_l)V_T\ln(p\cdot r)$$

The first term $V_{E3}$ 128, has a negative temperature coefficient (−2 mV/° C.) and the second term has a positive, "designable" temperature coefficient (+2 mV/° C.).

FIG. 3*b* is a schematic drawing of an alternative embodiment to that shown in FIG. 3*a*. This embodiment also equates the temperature coefficients of $V_{E3}$ 128 and $I_3$ 126 and minimizes the voltage difference between nodes 134 and 136. This is accomplished by tying the bases of $Q_1$ 116, $Q_2$ 118, and $Q_3$ 130 together and placing the resistor $R_3$ 124 between ground and the collector of $Q_3$ 130. The voltage at node 342, where the bases of these transistors are tied together is PTAT and is determined by $I_3$ 126 multiplied by $R_3$ 132. And, by nature of a bipolar transistor, when active, the base-emitter voltage drop is reasonably CTAT. Thus, the voltage at node 134 is the voltage at node 342 plus $V_{be}$. The voltage at node 136 is the voltage at node 342 plus $V_{be}$. Therefore, the difference in drain voltages at nodes 134 and 136 is held constant and minimized. Like the circuit in FIG. 3*a*, the overhead voltage can be reduced, allowing for a reduced operating voltage. One additional benefit of this embodiment is that the requirement that the input terminals $V_{C1}$ 112 and $V_{C2}$ 114 of the current differencing amplifier AR1 110 be close to 0V can be relaxed. The input terminals can be up to 1V over the entire temperature range. This is due to node 342 not being grounded.

A modification that can be made to the circuit of FIG. 3*b* is to place a unity gain buffer 344 between the collector of transistor $Q_3$ 130 and the bases of transistors $Q_1$ 116, $Q_2$ 118, and $Q_3$ 130. The modification to this circuit allows $V_{REF}$ 102*b* to be temperature curvature corrected, and thus more stable over a given temperature range. This is important to consider as BJT alpha, the carrier injection efficiency, decreases at high and low temperature extremes (due to variations in carrier mobility). Without the unity gain buffer 344, the base current of $Q_3$ 130 contributes to the current through $R_3$ 132. In addition to adding the amplifier, the emitter area of $Q_3$ should be scaled so that $Q_3$ has the same current density as $Q_l$.

Figure 4A:
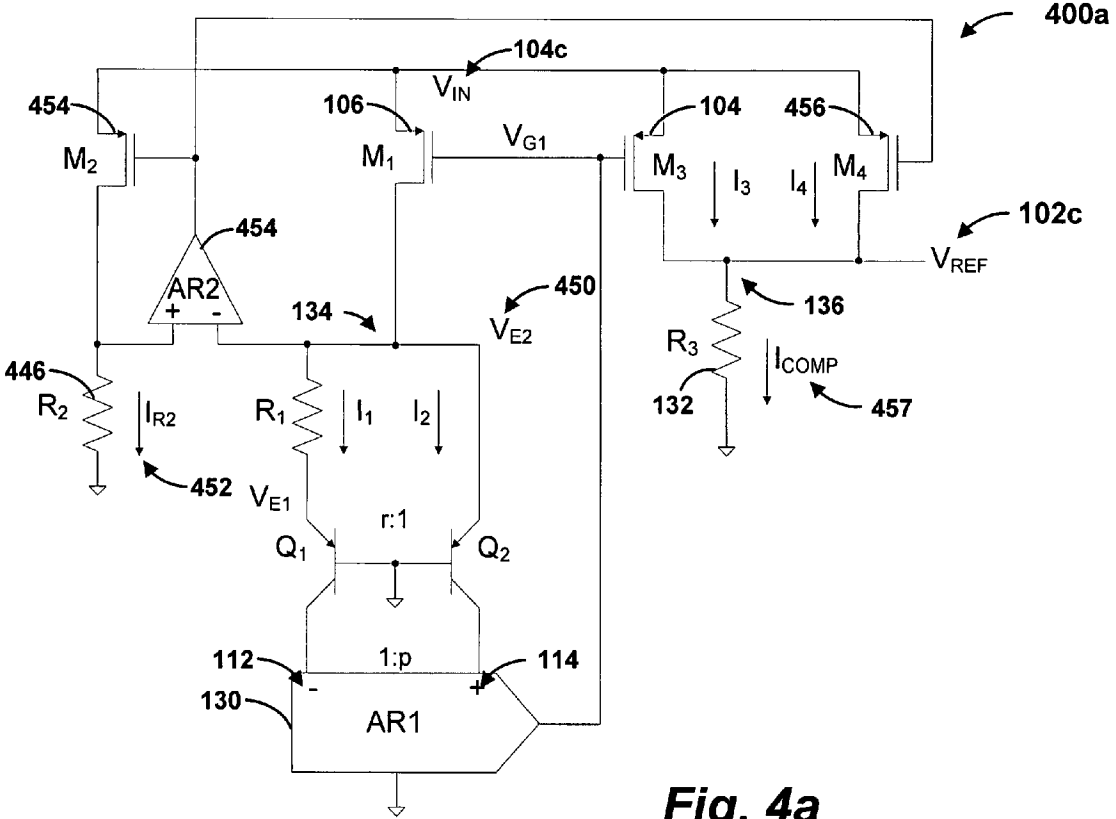
FIG. 4*a* is a schematic drawing of a temperature compensated voltage reference circuit implementing a current conveyer so as to balance the temperature coefficient of an output voltage in accordance with one embodiment of the present invention.

The embodiments of FIGS. 3*a* and 3*b*, as described above, are both bandgap reference circuits. In other embodiments, a sub-bandgap reference may be employed. A sub-bandgap reference allows lower operating voltages when compared to a bandgap reference circuit. However, even conventional sub-bandgap references may have unwanted overhead. Circuit 400*a* in FIG. 4*a*, is a circuit embodiment of sub-bandgap reference circuit with reduced overhead operating voltage. In this embodiment, a temperature coefficient adjustment circuit comprises an amplifier 454 used in combination with FETs $M_2$ 454 and $M_3$ 456 and resistor $R_2$ 446; the temperature coefficient adjustment circuit acts as a current conveyer. The other components are similar to the embodiments of FIGS. 3*a* and 3*b*, however $Q_3$ 130 is removed.

The change in current with temperature through $M_1$ (PTAT) is mirrored through to transistor $M_3$ 104. The voltage at node 134, however, is CTAT. This negative voltage is used to produce a current $I_{R2}$ 452 through resistor $R_2$ 446 via amplifier 454. Because the voltage at node 134 is CTAT, the current $I_{R2}$ 452 is also CTAT. This current is conveyed to FET $M_4$ 456 and summed with the current through $M_3$ 104 to produce a temperature compensated current $I_{comp}$ 456 through resistor $R_3$ 132. The temperature coefficients are effectively balanced at node 136. A temperature compensated voltage $V_{REF}$ 102*c* may be created with resistor $R_3$ 126. The equation for $V_{REF}$ 102*c* is as follows:

$$V_{REF}=R_3[(V_{E2}/R_2)+(p+1)(V_T/R_1)\ln(p\ r)]$$

The temperature coefficients of the first and second terms within the brackets are set equal to each other. Other considerations such as the matching of FETs $M_2$ 454 and $M_4$ 456 may also need to be considered in the design circuit 400*a*.

Figure 4B:
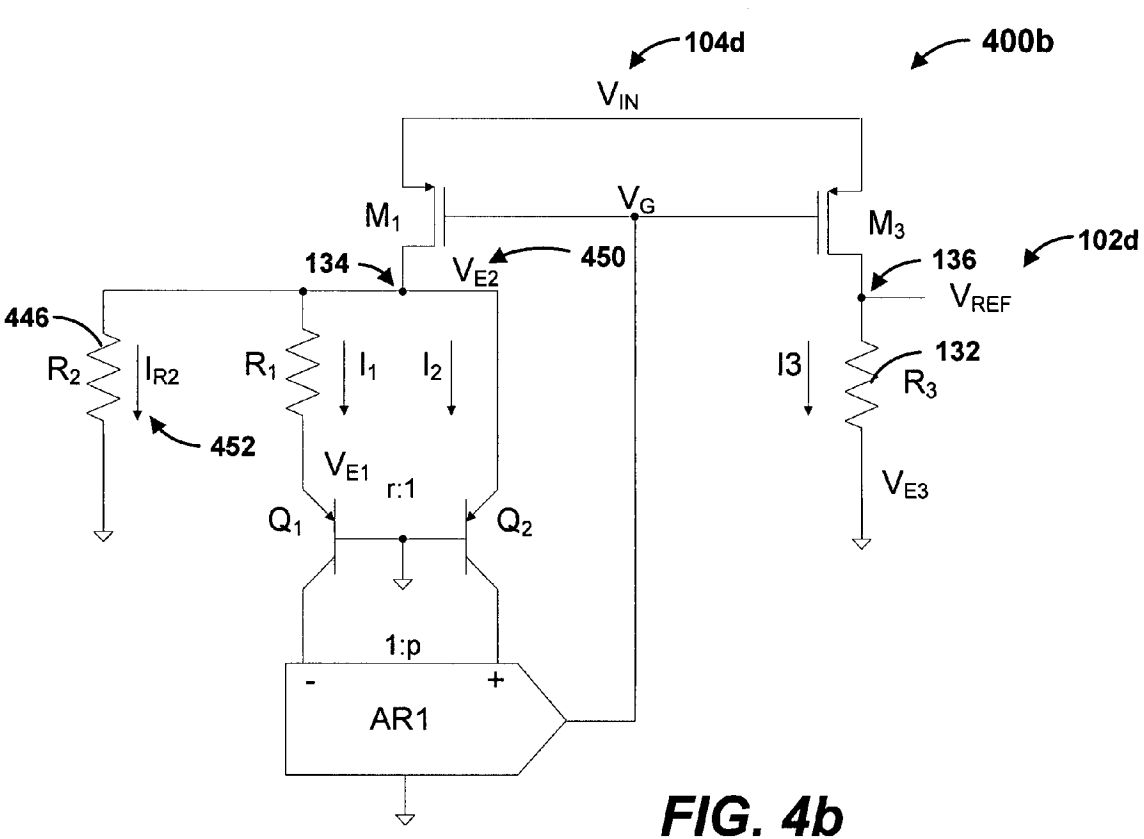
FIG. 4*b* is a schematic drawing of a temperature compensated voltage reference circuit implementing a resistor used to balance the temperature coefficient of an output voltage in accordance with one embodiment of the present invention.

Alternative to the embodiment of FIG. 4*a*, is reference circuit 400*b* presented in FIG. 4*b*. In reference circuit 400*b*, resistor $R_2$ 452 is directly coupled with node 134. Instead of using a current conveyer to balance the temperature coefficients of the currents entering node 136, the temperature coefficient of $V_{E2}$ 450 is adjusted by drawing current away from node 134 through resistor $R_2$ 446. The same equation for calculating $V_{REF}$ 102*c* applies in calculating $V_{REF}$ 102*d*.

A circuit designer may choose either embodiment of circuit 400*a* or 400*b* to produce a sub-bandgap reference circuit. Both embodiments provide advantages in manufacturing. Circuit 400*a* has more components associated with it than circuit 400*b*; however, when calibrating the circuit it is relatively simple to adjust the current conveyer. The resistor 446, when used by itself, as in circuit 400*b* may be more difficult to calibrate than the current conveyer of circuit 400*a*. However, less circuit components are required.

Figure 5:
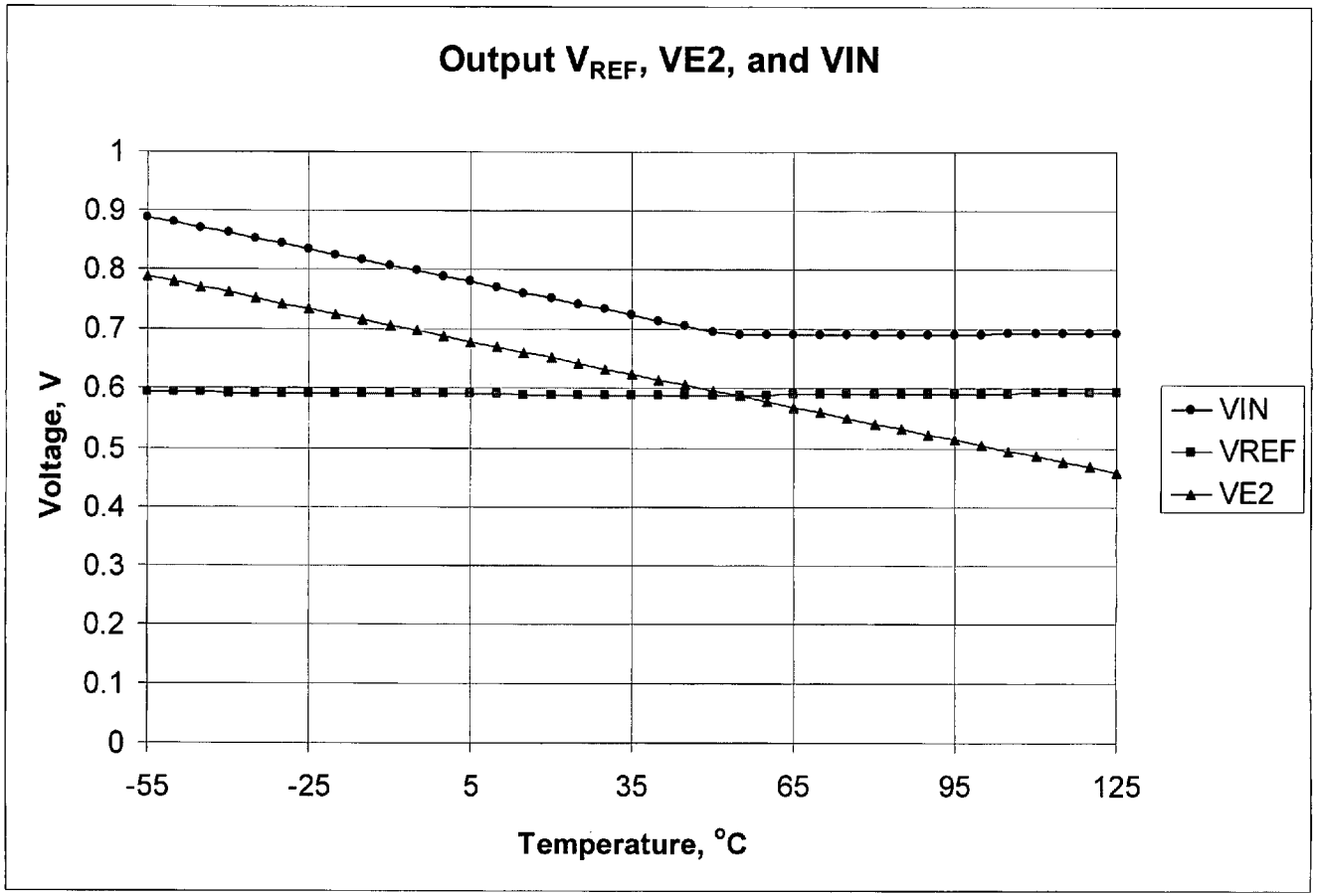
FIG. 5 is a graph illustrating $V_{REF}$, $V_{E2}$, and $V_{IN}$ vs. temperature of the circuits in FIG. 4*a* and FIG. 4*b;*

FIG. 5 is a graph that shows the minimum allowable operating voltage $V_{IN}$, for $V_{REF}$ and $V_{E2}$ of the embodiments of FIGS. 4*a* and 4*b*. As temperature is increased, $V_{E2}$ and $V_{IN}$ decrease. $V_{REF}$, however, is constant over the entire temperature range.

Figure 6:
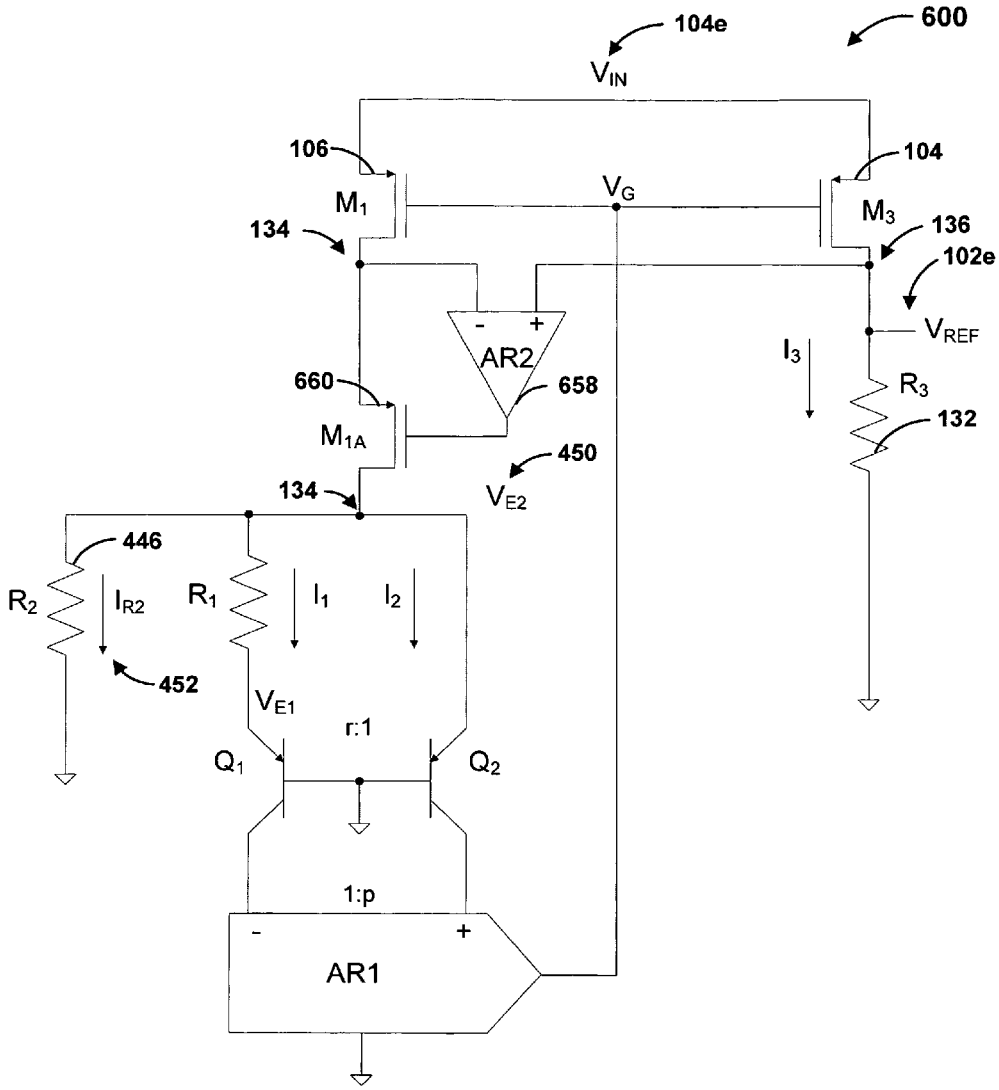
FIG. 6 is a schematic drawing of a temperature compensated voltage reference circuit implementing an amplifier and a first FET as a voltage regulator and a resistor used to balance the temperature coefficient of an output voltage in accordance with one embodiment of the present invention.

FIG. 6 is an alternative embodiment of that shown in FIGS. 4*a* and 4*b*. Circuit 600 uses the voltage at node 134 to balance the temperature coefficients of $V_{REF}$ 102*e* in the same way the circuits of FIGS. 4*a* and 4*b*. And, in the same manner of the circuit in FIG. 3*a*, an amplifier 658 is used with FET $M_{1A}$ 660 to equate the voltages at nodes 134 and 136 (thus, minimizing channel length modulation and in turn reducing PSR limitations). The output voltage, $V_{REF}$ 102*e*, is set via $R_3$ 132. In this embodiment, $V_{REF}$ 102*e* should be about 100 mV higher than the highest value of $V_{E2}$ 450 (about 800 mV at −55° C.) for the circuit to work properly; thus the operational voltage, $V_{IN}$ 104*e*, is no longer 0.9V but 1V. Again, the output voltage is less than the standard bandgap voltage output of 1.2V.

In alternative embodiments of FIG. 6, the FET $M_{1A}$ 660 may be coupled with node 136 (i.e., the source of $M_{1A}$ 660 coupled with the drain of $M_3$ 104 and node 134 coupled with the drain of $M_1$ 106). This embodiment may be used for lower reference voltages.

Figure 7A:
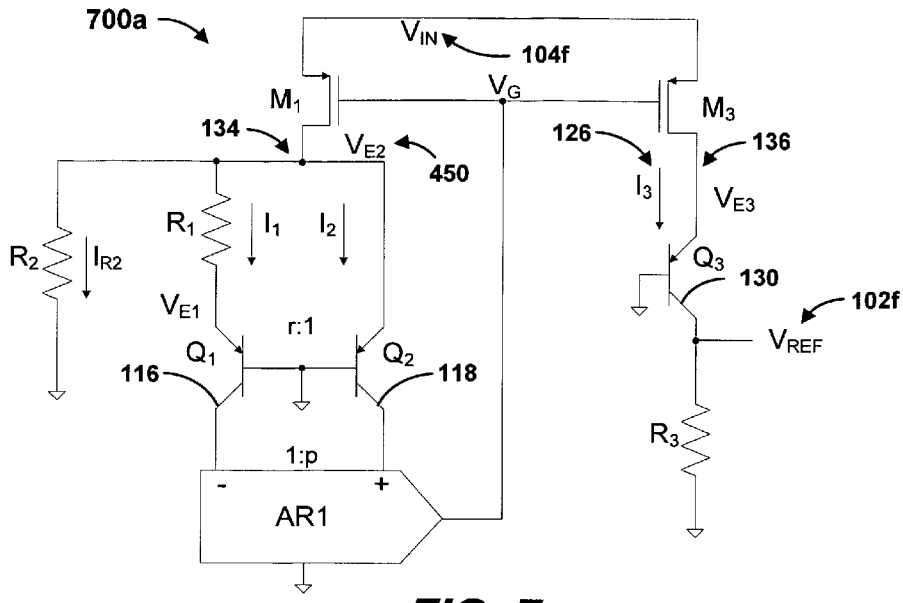
FIG. 7*a* is a schematic drawing of a temperature compensated voltage reference circuit implementing an additional BJT as a voltage regulator and a resistor used to balance the temperature coefficient of an output voltage in accordance with one embodiment of the present invention.

Instead of using an amplifier and a FET, a BJT may be used to regulate the voltages at nodes 134 and 136 (as in FIG. 3*b*). FIG. 7*a* is an alternative embodiment of that shown in FIGS. 4*a* and 4*b*. Circuit 700*a* also uses the voltage at node 134 to balance the temperature coefficients of $V_{REF}$ 102*f*. This circuit, however, employs transistor $Q_3$ 130 in between $V_{REF}$ 102 and node 136. Analogous to the circuit of FIG. 3*b*, $V_{be}$ is added to the voltage at the base of transistors $Q_1$ 116, $Q_2$ 118, and $Q_3$ 130. Because the base is grounded or common at all of these transistors, the difference in voltage at nodes 134 and 136 is minimized. In this embodiment, however, $V_{REF}$ 102 must be 100 mV less than the minimum value of $V_{E2}$ 450 (400 mV at 125° C.) or 300 mV. This is necessary to prevent voltage saturation of $Q_3$ 130.

Figure 7B:
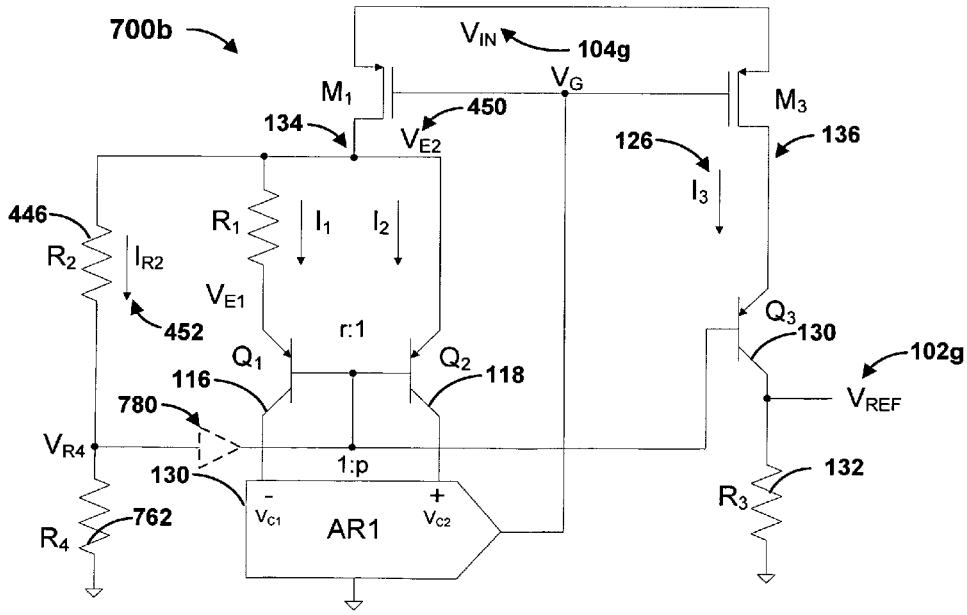
FIG. 7*b* is a schematic drawing of a temperature compensated voltage reference circuit implementing an additional BJT as a voltage regulator and two resistors used to balance the temperature coefficient of an output voltage in accordance with one embodiment of the present invention.

FIG. 7*b* is an alternative embodiment of that shown in FIG. 7*a*. The equating of temperature coefficients as well as the minimization of the difference in voltage at nodes 134 and 136 are identical to the embodiment of FIG. 7*a*. However, the bases of $Q_1$ 116, $Q_2$ 118, and $Q_3$ 130 are tied together and an additional resistor, $R_4$ 762, is added between $R_2$ 446 and ground 448 in order to increase the compliance voltage of AR1 110 as well as increase the output voltage $V_{REF}$ 102*g*. The current $I_{R2}$ 452 through $R_2$ 446 stays the same as in the embodiment of FIG. 7*a*; that is, $I_{R2}=V_{be}/R2$, but $V_{E2}$ 450 (and $V_{E3}$) increases by a factor of $(1+R_4/R_2)$. Circuit 700*b* may be more practical to implement for certain processing limitations.

One additional benefit of both of the embodiments in FIGS. 7*a* and 7*b* is that they tend to be temperature curvature-corrected. Typical variations in output voltages normally observed at extreme temperatures in voltage reference circuits are mitigated by the circuits of FIGS. 7*a* and 7*b*. Essentially, this is achieved by counteracting the deviation in alpha (from $Q_1$ 116 and $Q_2$ 118) by multiplying $I_3$ 126 with a reciprocal function, that function being the transistor alpha that produces the deviation. In the embodiment of FIG. 7*a*, this multiplication is accomplished by the placement of $Q_3$ 130 in series with $R_3$ 132, where the base current is shunted to ground. In the embodiment of FIG. 7*b*, the same principle of curvature-correction may also be applied. In this embodiment, the extra base currents at high and low temperatures will cause an additional curvature in the voltage across $R_4$ 762. This results in an insignificant increase in the minimum $V_{IN}$ 104 requirements but does not hinder the correction of the $V_{REF}$ 102 output. Adding a unity gain buffer 780 will also isolate the base currents of transistors $Q_1$ 116, $Q_2$ 118 and $Q_3$ 130. This may also facilitate temperature curvature-correction.

Figure 8:
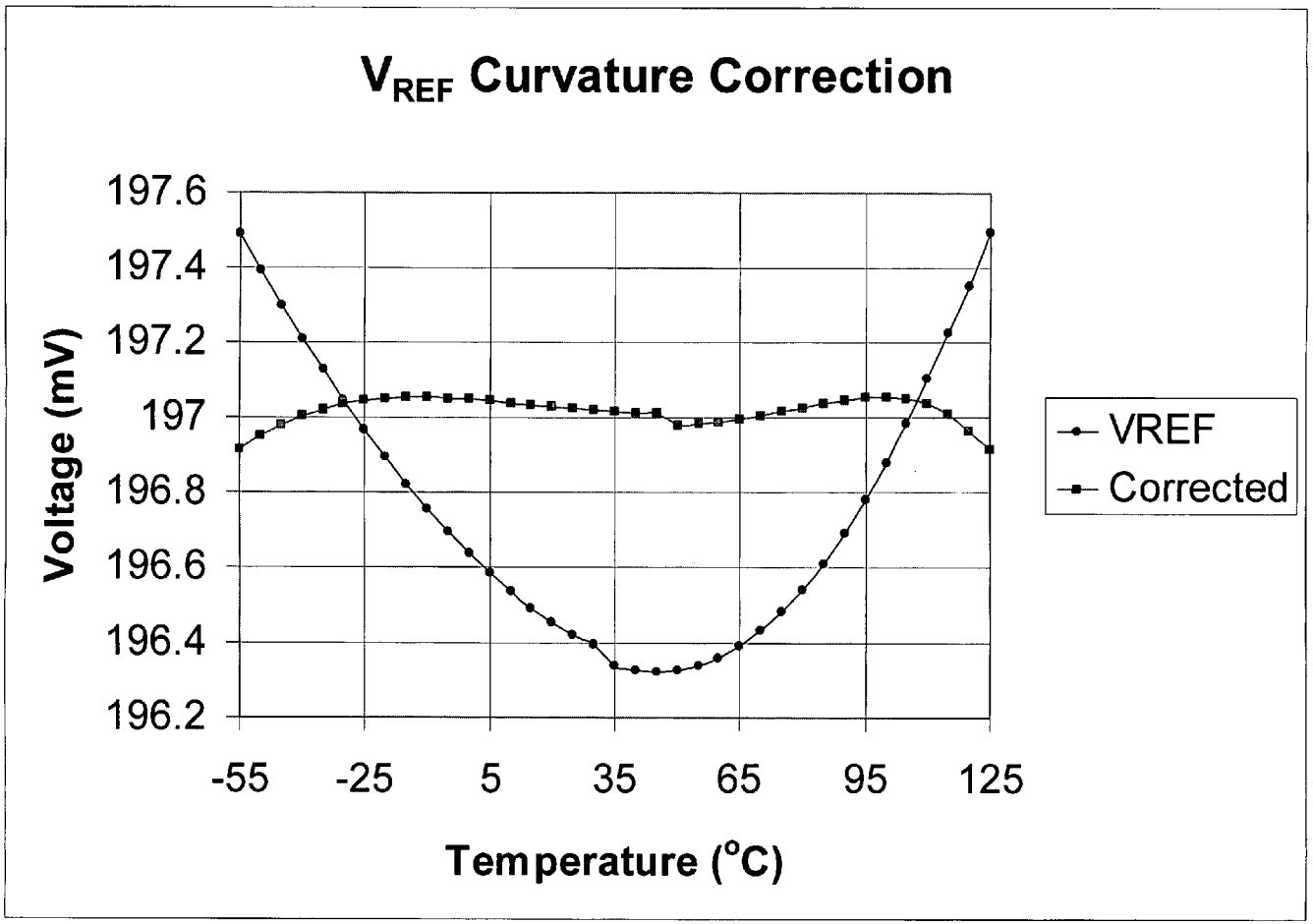
FIG. 8 is a graph illustrating $V_{REF}$ and a corrected $V_{REF}$ vs. temperature of the circuit in FIG. 7*a;*

FIG. 8 is a plot of an example of a curvature-corrected output of the embodiment of FIG. 7*a*. In order to obtain this curve, $Q_3$ 130 is sized to be nine times larger than $Q_2$ 118 so that $Q_1$ 116 and $Q_3$ 130 both have the same current density going through them. The resistance of $R_3$ 132 is increased by 7.5% to offset the average loss of base current through $Q_3$ 130. This simple curvature correction is able to reduce temperature error from 0.60% to 0.072% over an entire 180° C. range.

Figure 9B:
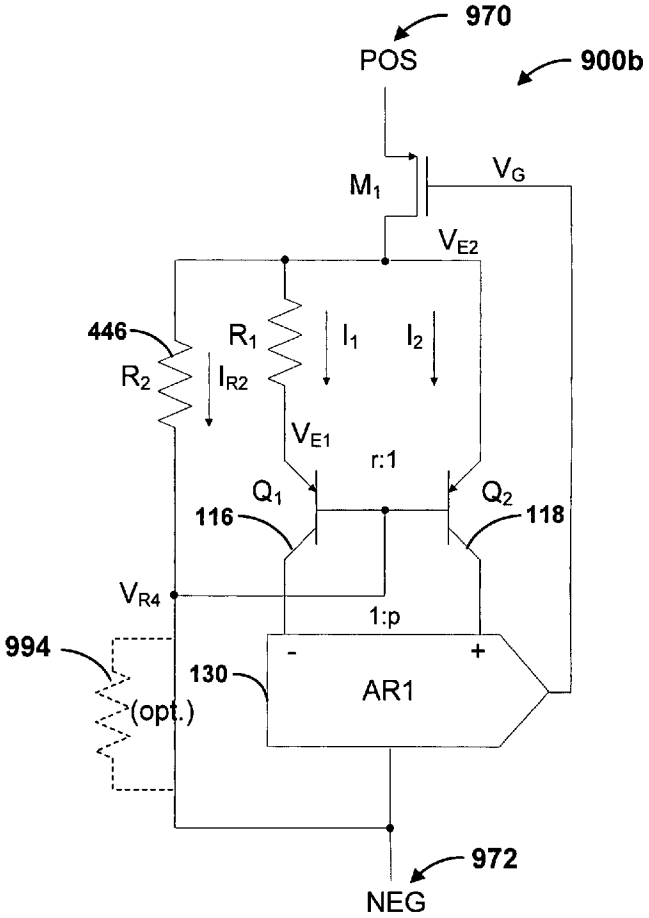
FIG. 9*b* is a schematic drawing of a temperature compensated current source using the ground terminal of a current differencing amplifier to balance the temperature coefficient of an output current in accordance with one embodiment of the present invention.
Figure 9A:
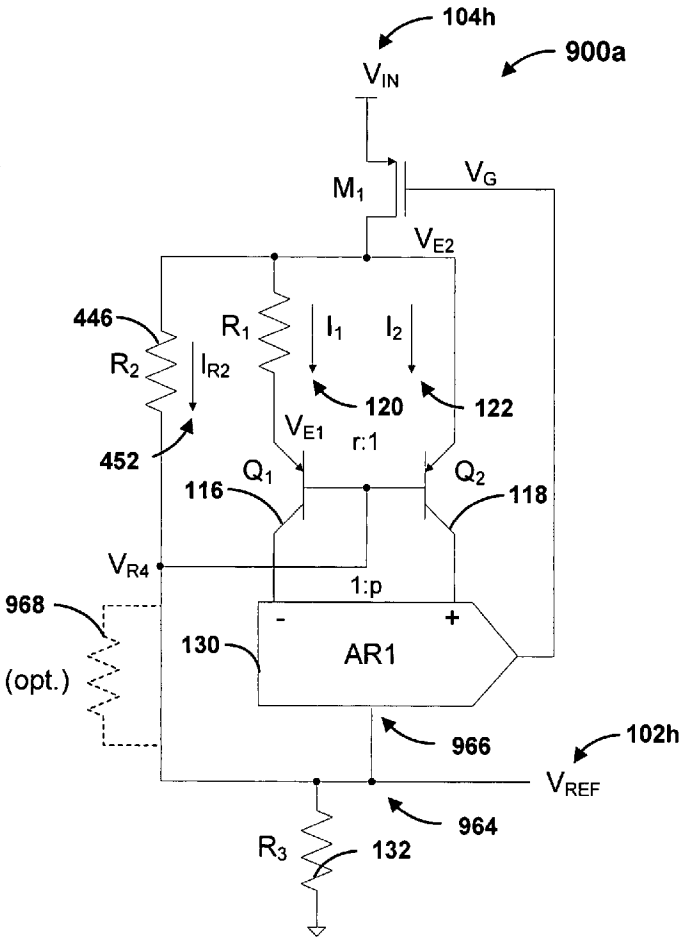
FIG. 9*a* is a schematic drawing of a temperature compensated voltage source using the ground terminal of a current differencing amplifier to balance the temperature coefficient of an output voltage in accordance with one embodiment of the present invention.

FIG. 9*a* is a schematic drawing of another embodiment of a temperature compensated voltage reference circuit that eliminates the effects of channel length modulation by removing transistor $M_3$ and referencing the output voltage at node 964. The ground terminal 966 of AR1 130 is coupled with $R_3$ 132. The temperature compensation is accomplished by summing the currents $I_1$ 120, $I_2$ 122 and $I_{R2}$ 452 entering node 964. The resistor $R_3$ 132 can be chosen to establish a desired output voltage. The ground terminal 966 of the current differencing amplifier 130 supplies the summation of currents $I_1$ 120 and $I_2$ 122. An additional resistor 968, analogous to resistor $R_4$ 762 in FIG. 7*b*, can be placed in between the node joining $R_2$ 446, $R_3$ 132, and the bases of $Q_1$ 116 and $Q_2$ 118. This resistor may aid in the implementation of AR1 130.

FIG. 9*b* is an alternative embodiment to the circuit of FIG. 9*a*. This circuit takes advantage of all of the properties of the previous embodiment, however, $R_3$ is removed and the operating voltage $V_{IN}$ is labeled "POS" 970 and the $V_{REF}$ output is labeled "NEG" 972. In this embodiment, a minimal supply voltage of at least 0.9V is placed across these two terminals and a temperature compensated two-terminal constant current source is formed. When placed in a loop with a power supply and a zero temperature coefficient resistor, it can be used to develop any desired voltage across the zero temperature coefficient resistor. It could also be made to exhibit a wide range of non-zero temperature coefficients by varying either R2/R1 or p. Like the embodiment of FIG. 9*a*, a resistor 994 can be inserted between the node joining $R_2$ 446, NEG 972, and the bases of $Q_1$ 116 and $Q_2$ 118.

One additional method for lowering the input voltage of all of the above embodiments is to replace some or all of the transistors, particulary the bipolar, with Dynamic-Threshold MOS transistors (DTMOS) transistors. In doing so, all of the above embodiments could have operating voltages as low as 500 mV. DTMOS transistors are a form of lateral bipolar transistors that use a vestigial gate to separate the emitter and collector regions. They are particularly useful with all of the above embodiments when their vestigial gates are tied to their bases. The bandgap voltage (when extrapolated to zero Kelvin) of these transistors is about 0.6V rather 1.2V. In addition, the $V_{be}$ temperature gradient is 1 mV/° C. rather than 2 mV/° C.

Figure 10A:
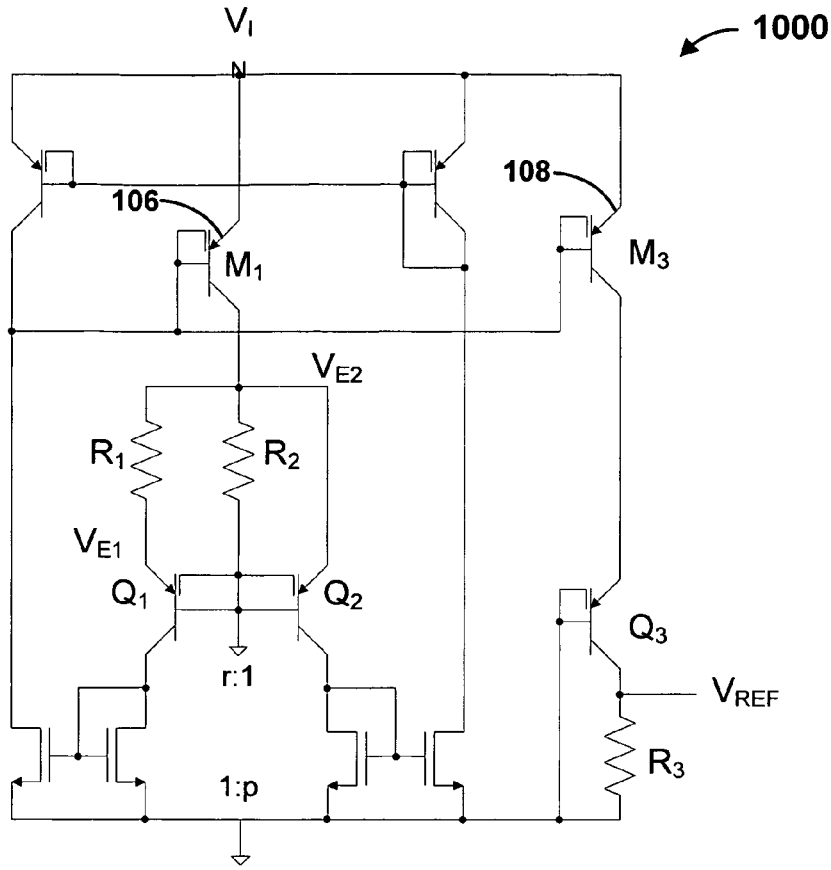
FIG. 10*a* is a schematic drawing of a voltage reference circuit whereby transistors in the reference circuit have been replaced with Dynamic-threshold MOS transistors (DT-MOS) in accordance with one embodiment of the present invention.

In FIG. 10*a*, an alternative embodiment of FIG. 7*a* is shown with DTMOS transistors replacing all bipolar and MOS transistors. The differencing amplifier, AR1 130, of the previous embodiments is shown with MOS transistor components.

Figure 10B:
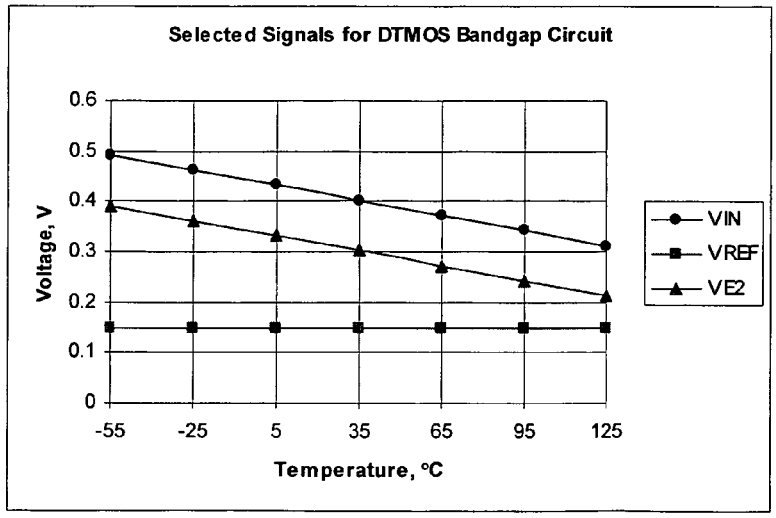
FIG. 10*b* is a graph illustrating $V_{REF}$, $V_{E2}$, and $V_{IN}$ vs. temperature of the circuits in FIG. 10*b*.

A graph of the operating voltage, $V_{IN}$, and the output voltage, $V_{REF}$, is shown vs. temperature is shown in FIG. 10*b*. This graph demonstrates that an operating voltage of 0.5V or less can be achieved by implementing DTMOS transistors.

One additional implementation that should also be recognized in the above embodiments is replacing transistor $M_1$ 106 and $M_3$ 108 with PNP bipolar transistors. If a dual well or silicon-on-insulator process is available, these transistors offer additional advantages. Namely, they require less area and they also have less PSR limitations.

Embodiments of the present invention have been described above. A low voltage reference circuit with reduced operating overhead may be created by regulating the voltage at the drains of FETs within the reference circuit. In sub-bandgap circuits, the temperature coefficients of an output current or voltage may be adjusted to zero via a current conveyer or an extra current tap. A current source may also be constructed using the above methods. The current source may be used to create a range of temperature compensated voltages.

All of the transistors in the above embodiments may be fabricated in a variety of ways. Different types of FETs (such as n-MOS, or DTMOS) or BJTs (such as NPN) may be implemented to construct alternative embodiments. Those skilled in the art will understand, however, that additional changes and modifications may be made to these embodiments without departing from the true scope and spirit of the present invention, which is defined by the claims.

I claim:

1. A low voltage reference circuit comprising:

first and second Bipolar Junction Transistors (BJTs) each having an associated operating current and having interconnected bases coupled with a common node;

a first resistor having first and second terminals, the first terminal coupled with an emitter of the first BJT transistor;

first and second Field Effect Transistors (FETs) having interconnected gates and interconnected sources;

a current-differencing amplifier having first and second input terminals and an output terminal, the first input terminal coupled with a collector of the first BJT, the second input terminal coupled with a collector of the second BJT, and the output terminal coupled with the interconnected gates of the first and second FETs, wherein a difference in operating currents of the first and second BJTs results in a corresponding output voltage at the output terminal;

voltage regulating circuitry coupled with a drain of the first and second FETs and the second terminal of the first resistor; whereby the voltage regulating circuitry minimizes the voltage difference between the drain of the first FET and the drain of the second FET;

a second resistor having first and second terminals, the second terminal coupled with the drain of the second FET; and a third BJT having a base, a collector, and an emitter, the emitter coupled with the first terminal of the second resistor and the base coupled with the collector.

2. The low voltage reference circuit as in claim 1, wherein the first and second BJTs are lateral BJTs each having a vestigial gate coupled with the interconnected bases of the first and second BJTs.

3. The low voltage reference circuit as in claim 1, wherein the voltage regulating circuit further comprises:

an amplifier having first and second input terminals and an output; the first input terminal coupled with the drain of the first FET and the second input terminal coupled with the drain of the second FET; and a third FET having a source, a gate, and a drain, the source being coupled with the drain of the first FET, the gate coupled with the output of the amplifier, and the drain coupled with the second terminal of the first resistor.

4. A low voltage reference circuit comprising:

first and second Bipolar Junction Transistors (BJTs) each having an associated operating current and having interconnected bases;

first and second Field Effect Transistors (FETs) having interconnected gates and interconnected sources;

a first resistor having first and second terminals, the first terminal coupled with an emitter of the first BJT and the second terminal coupled with an emitter of the second BJT and a drain of the first FET;

a current-differencing amplifier having first and second input terminals and an output terminal, the first input terminal coupled with a collector of the first BJT, the second input terminal coupled with a collector of the second BJT, and the output terminal coupled with the interconnected gates of the first and second FET, wherein a difference in operating currents of the first and second BJTs results in a corresponding output voltage at the output terminal;

a third BJT having a base, an emitter, and a collector, the emitter coupled with a drain of the second FET, the base coupled with the interconnected bases of the first and second BJTs, and the collector coupled to the base; and a second resistor coupled with a collector of the third BJT.

5. The low voltage reference circuit as in claim 4, wherein the first and second BJTs are lateral BJTs each having a vestigial gate coupled with the interconnected bases of the first and second BJTs.

6. The low voltage reference circuit as in claim 4, wherein a unity gain amplifier is used to couple the collector of the third BJT to the base of the third BJT, thereby temperature curvature correcting the low voltage reference circuit.

7. A low voltage reference circuit comprising:

first and second Bipolar Junction Transistors (BJTs) each having an associated operating current and having interconnected bases connected at a common node;

first and second Field Effect Transistors (FETs) having interconnected gates and interconnected sources;

a first resistor having first and second terminals, the first terminal coupled with an emitter of the first BJT and the second terminal coupled with an emitter of the second BJT and a drain of the first FET;

a current-differencing amplifier having first and second input terminals and an output terminal, the first input terminal coupled with a collector of the first BJT, the second input terminal coupled with a collector of the second BJT, and the output terminal coupled with the interconnected gates of the first and second FETs, wherein a difference in operating currents of the first and second BJTs results in a corresponding output voltage at the output terminal;

a second resistor having first and second terminals, the second terminal coupled with a drain of the second FET; and a temperature coefficient adjustment circuit coupled with the second terminal of the first resistor, wherein the temperature coefficient adjustment circuit is used to reduce a change in current through the second resistor due to temperature.

8. The low voltage reference circuit as in claim 7, wherein the first and second BJTs are lateral BJTs each having a vestigial gate coupled with the interconnected bases of the first and second BJTs.

9. The low voltage reference circuit as in claim 7 wherein temperature coefficient adjustment circuit is a current conveyer, the current conveyer comprising:

an amplifier having first and second inputs and an output, the second input coupled with the second terminal of the first resistor;

third and fourth FETs having interconnected gates and interconnected sources, wherein the interconnected gates are coupled with the output of the amplifier, a drain of the third FET is coupled with the first input of the amplifier, and a drain of the fourth FET is coupled with the drain of the second FET; and a third resistor having first and second terminals, the first terminal coupled with the first input of the amplifier.

10. The low voltage reference circuit as in claim 7, wherein temperature coefficient adjustment circuit is a third resistor coupled with a drain of the first FET.

11. A low voltage reference circuit comprising:

first and second Bipolar Junction Transistors (BJTs) each having an associated operating current and having interconnected bases connected at a common node;

a first resistor having first and second terminals, the first terminal coupled with an emitter of the first BJT;

first and second Field Effect Transistors (FETs) having interconnected gates and interconnected sources;

a current-differencing amplifier having first and second input terminals and an output terminal, the first input terminal coupled with a collector of the first BJT, the second input terminal coupled with a collector of the second BJT, and the output terminal coupled with the interconnected gates of the first and second FETs, wherein a difference in operating currents of the first and second BJTs results in a corresponding output voltage at the output terminal;

a second resistor coupled with the second terminal of the first resistor;

voltage regulating circuitry coupled with a drain of the first and second FETs, the second terminal of the first resistor, and a third resistor, whereby the voltage regulating circuitry minimizes the voltage difference between the drain of the first FET and the drain of the second FET.

12. The low voltage reference circuit as in claim 11, wherein the first and second BJTs are lateral BJTs each having a vestigial gate coupled with the interconnected bases of the first and second BJTs.

13. The low voltage reference circuit as in claim 11, wherein the voltage regulating circuit further comprises:

an amplifier having first and second input terminals and an output; the first input terminal coupled with the drain of the first FET and the second input terminal coupled with the drain of the second FET; and a third FET having a source, a gate, and a drain, the source being coupled with the drain of the first FET, the gate coupled with the output of the amplifier, and the drain coupled with the second terminal of the first resistor.

14. The low voltage reference circuit as in claim 11, wherein the voltage regulating circuit further comprises:

an amplifier having first and second input terminals and an output; the first input terminal coupled with the drain of the first FET and the second terminal of the first resistor, and the second input terminal coupled with the drain of the second FET; and a third FET having a source, a gate, and a drain, the source being coupled with the drain of the second FET, the gate coupled with the output of the amplifier, and the drain coupled with the third resistor.

15. A low voltage reference circuit comprising:

first and second Bipolar Junction Transistors (BJTs) each having an associated operating current and having interconnected bases coupled with a voltage source;

first and second Field Effect Transistors (FETs) having interconnected gates and interconnected sources;

a first resistor having first and second terminals, the first terminal coupled with an emitter of the first BJT and the second terminal coupled with an emitter of the second BJT and a drain of the first FET;

a current-differencing amplifier having first and second input terminals and an output terminal, the first input terminal coupled with a collector of the first BJT, the second input terminal coupled with a collector of the second BJT, and the output terminal coupled with the interconnected gates of the first and second FETs, wherein a difference in operating currents of the first and second BJTs results in a corresponding output voltage at the output terminal;

a third BJT having a base coupled with the voltage source and an emitter coupled with a drain of the second FET;

a second resistor having first and second terminals, the first terminal coupled with a collector of the third BJT; and a third resistor having first and second terminals, the first terminal coupled with the drain of the first FET.

16. The low voltage reference circuit as in claim 15, wherein the first and second BJTs are lateral BJTs each having a vestigial gate coupled with the interconnected bases of the first and second BJTs.

17. The low voltage reference circuit as in claim 15, further comprising a fourth resistor having first and second terminals, the first terminal coupled with the second terminal of the third resistor and the first terminal being coupled to the interconnected bases of the first and second BJTs and the base of the third BJT, wherein the voltage source is provided at the first terminal of the fourth resistor.

18. The low voltage reference circuit as in claim 17, wherein a unity gain amplifier is used to couple the first terminal of the fourth resistor to the interconnected bases of the first and second BJTs and the base of the third BJT, thereby temperature curvature correcting the low voltage reference circuit.

19. A low voltage current source, comprising:

first and second Bipolar Junction Transistors (BJTs) each having an associated operating current and having interconnected bases coupled with a voltage source;

a first resistor having first and second terminals, the first terminal coupled with an emitter of the first BJT and the second terminal coupled with an emitter of the second BJT;

a first Field Effect Transistor (FETs) having a drain coupled with the second terminal of the first resistor;

a current-differencing amplifier having first and second input terminals, an output terminal, and a ground terminal, the first input terminal coupled with a collector of the first BJT, the second input terminal coupled with a collector of the second BJT, and the output terminal coupled with a gate of the first FET, wherein a difference in operating currents of the first and second BJTs results in a corresponding output voltage at the output terminal; and a second resistor having first and second terminals, the first terminal coupled with the drain of the first FET and the second terminal coupled to the ground terminal of the current-differencing amplifier.

20. The low voltage current source as in claim 19, wherein the first and second BJTs are lateral BJTs each having a vestigial gate coupled with the interconnected bases of the first and second BJTs.

21. The low voltage current source as in claim 19, wherein a third resistor is used to couple the second terminal of the second resistor to the ground terminal of the current-differencing amplifier.

22. The low voltage current source as in claim 19, wherein a third resistor is coupled with the ground terminal of the current-differencing amplifier so as to produce a temperature invariant voltage.

23. The low voltage current source as in claim 22, wherein a fourth resistor is coupled with the ground terminal of the current-differencing amplifier so as to produce a temperature invariant voltage.

* * * * *

UNITED STATES PATENT AND TRADEMARK OFFICE

CERTIFICATE OF CORRECTION

PATENT NO. : 7,122,997 B1
APPLICATION NO. : 11/267361
DATED : October 17, 2006
INVENTOR(S) : Paul M. Werking It is certified that error appears in the above-identified patent and that said Letters Patent is hereby corrected as shown below:

On the Title Page, Item (56) Other Publications, -- R.J. Widlar, "New Development in -- should be -- R.J. Widlar, "New Developments in --

Signed and Sealed this
Nineteenth Day of April, 2011

David J. Kappos

David J. Kappos
*Director of the United States Patent and Trademark Office*